US006732398B2

(12) United States Patent
McConnell

(10) Patent No.: US 6,732,398 B2
(45) Date of Patent: May 11, 2004

(54) STEPPED DIAMETER BRISTLES FOR A TOOTHBRUSH

(75) Inventor: Thomas P. McConnell, Maple Valley, WA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/027,697

(22) Filed: Dec. 20, 2001

(65) Prior Publication Data

US 2003/0115704 A1 Jun. 26, 2003

(51) Int. Cl.[7] ..... A46B 15/00

(52) U.S. Cl. ..... 15/207.2; 15/167.1; 428/399; 428/401

(58) Field of Search ..... 15/167.1, 207.2; 428/397–401

(56) References Cited

U.S. PATENT DOCUMENTS

| | | | | | |
|---|---|---|---|---|---|
| 2,482,928 | A | * | 9/1949 | Neff et al. | 15/207.2 X |
| 2,607,064 | A | * | 8/1952 | Sullivan et al. | 15/207.2 X |
| 4,307,478 | A | * | 12/1981 | Ward et al. | 15/207.2 |
| 4,565,205 | A | * | 1/1986 | Taylor | 15/207.2 |
| 5,044,041 | A | * | 9/1991 | Ljungberg | 15/210.1 |
| 5,360,026 | A | * | 11/1994 | Klinkhammer | 132/308 |
| 5,459,899 | A | * | 10/1995 | Bauer | 15/167.1 |
| 5,701,629 | A | * | 12/1997 | O'Brien | 15/207.2 |
| 5,786,087 | A | * | 7/1998 | Cansler | 428/398 |
| 5,857,471 | A | * | 1/1999 | Harada | 132/321 |
| 6,090,488 | A | * | 7/2000 | Kweon | 429/399 |

FOREIGN PATENT DOCUMENTS

| | | | | |
|---|---|---|---|---|
| GB | 811195 | * | 4/1959 | 15/207.2 |
| WO | 96/09781 | | 4/1996 | |

* cited by examiner

*Primary Examiner*—Mark Spisich
(74) *Attorney, Agent, or Firm*—Ernestine C. Bartlett

(57) ABSTRACT

The bristles have a stepped configuration with a top portion with a uniform diameter of approximately 0.005 inches, a middle portion with a uniform diameter of approximately 0.006 inches and a base portion having a uniform diameter of approximately 0.007 inches.

4 Claims, 2 Drawing Sheets

STEPPED DIAMETER BRISTLES FOR A TOOTHBRUSH

TECHNICAL FIELD

This invention relates generally to toothbrush bristles and more particularly concerns a toothbrush bristle having a particular configuration.

BACKGROUND OF THE INVENTION

Toothbrush bristles of various configurations are known. More particularly relative to the bristle of the present invention, toothbrush bristles are known which change in cross-sectional diameter between the free end tip of the bristle and the base thereof which is secured in a bristle plate. Two examples of bristles having such a change in configuration are shown in U.S. Pat. No. 5,044,041 to Ljungberg and U.S. Pat. No. 6,090,488 to Kweon.

The configuration of toothbrush bristles is known to have an effect on the cleaning action of the toothbrush. In addition to cleaning the exposed surfaces of the teeth, however, it is typically desirable for bristles to be configured and arranged to produce interproximal cleaning, i.e. between the teeth, as well as cleaning between the teeth and the gum. The present invention is directed toward a particular bristle configuration which is particularly effective in producing improved cleaning action between a user's teeth and gums.

DISCLOSURE OF THE INVENTION

Accordingly, the present invention is a toothbrush bristle and a brushhead comprising a plurality of tufts of said bristles mounted on a bristle base plate, wherein the bristle has a stepped configuration which includes a smallest diameter, flexible top portion at the upper end of the bristle portion, a middle portion having a diameter slightly larger than the top portion, and a base portion having the largest diameter, providing stiffness and support for the bristle member.

BEST MODE FOR CARRYING OUT THE INVENTION

Figure 1A:
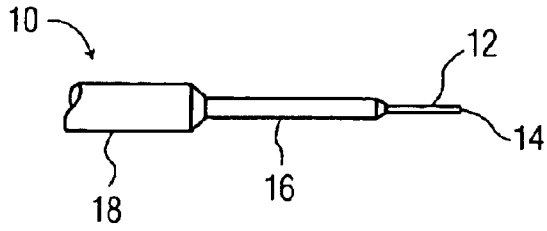
FIGS. 1A and 1B are an elevational view and an end view, respectively, of a single bristle of the present invention.
Figure 1B:
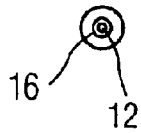

The present invention is directed toward a particular bristle configuration which is capable of producing a cleaning effect between the teeth and the gums of a user. The bristle configuration is shown in FIGS. 1A and 1B while a complete brushhead comprising a plurality of such bristles is shown in FIGS. 3A and 3B and FIGS. 4A and 4B.

The bristle shown generally at 10 has a conventional length and is made of conventional materials such as nylon or the like. The bristle 10 has three regions of different diameter along its length. The regions are not shown to scale in length. At an upper end of the bristles is a first, top bristle portion 12. First bristle portion 12 of the embodiment shown is circular in cross-section, with a diameter of 0.005 inches and a length of approximately 0.01 inches, although this can be varied somewhat. The particular diameter of the first bristle portion 12 is important, as the bristles must be sufficiently soft (a sufficiently small diameter) to get between the teeth and the gums conveniently during normal brush operations. If the diameter is too large, the bristles will be too stiff to enter between the teeth and the gums, while if the diameter is too small, the bristles will not be able to penetrate physically between the teeth and the gums.

The first bristle portion maintains its 0.005 diameter substantially along its entire length. The free end 14 of the first bristle portion is rounded, again to facilitate cleaning and insertion of the bristle tips between the teeth and the gums.

The second, middle bristle portion 16 is also circular in cross-section, with a slightly larger diameter than the first bristle portion, in the embodiment shown approximately 0.006 inches. The second bristle portion is also approximately circular in cross-section, the diameter remaining the same along the length of the second bristle portion, which also 0.01 inches long in the embodiment shown. The second bristle portion has a diameter which is sufficiently stiff to support the soft and flexible first bristle portion.

The third, base bristle portion 18 has a diameter of 0.007 inches and comprises approximately the remaining portion of the bristle in the embodiment shown. The third bristle portion provides support for the entire bristle, including sufficient stiffness for the second portion of the bristle.

Figure 2:
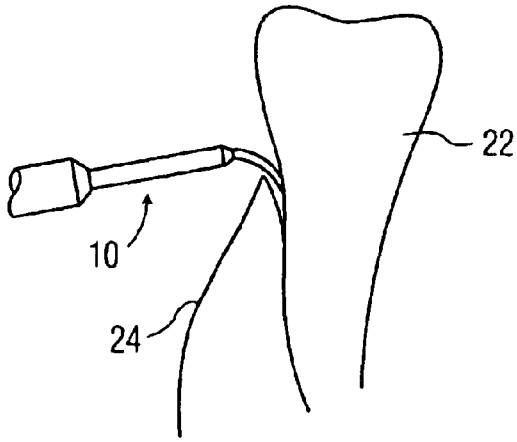
FIG. 2 shows the use of a bristle of the present invention between a tooth and the gum.
Figure 3A:
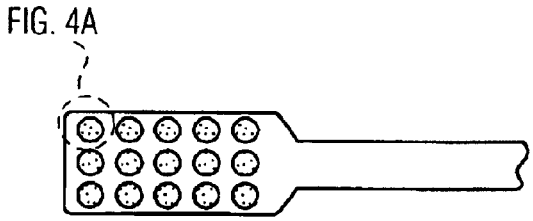
FIGS. 3A and 3B show a top view and a side elevational view of a toothbrush head using the bristle configuration of the present invention.
Figure 3B:
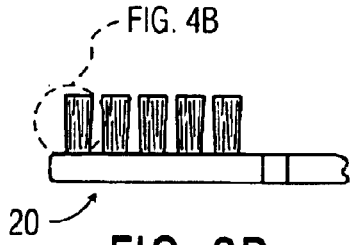
Figure 4A:
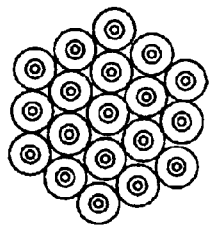
FIGS. 4A and 4B show an individual bristle tuft, including an individual bristle of the present invention.
Figure 4B:
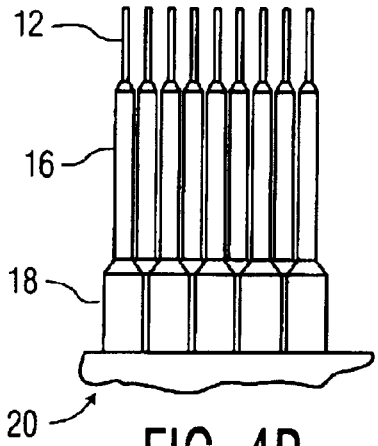

FIGS. 3A and 3B and 4A and 4B show the toothbrush bristle of the present invention in the context of a conventional brushhead 20. This brushhead can be used in either a manual toothbrush or in a power toothbrush. The toothbrush can be conveniently used with a circular or elliptical motion, with the bristle tips being placed directly against the teeth at approximately a right angle thereto. The elliptical motion of the brushhead would then be in the plane of the surface of the teeth. Referring to FIG. 2, such a motion will result in the small end-rounded bristle tips being forced down readily between the teeth 22 and the gums 24, providing good cleaning action between them. As indicated above, the larger diameter portions of the bristle provide the required stiffness for the bristles.

Hence, a new bristle configuration has been disclosed which provides necessary bristle stiffness for proper surface cleaning, but also includes a small diameter flexible portion at the top end thereof which provides a capability of entering between the teeth and the gums for cleaning between them. This cleaning effect improves the oral health of the user.

Although a preferred embodiment of the invention has been disclosed here for purposes of illustration, it should be understood that various changes, modifications and substitutions may be incorporated without departing from the spirit of the invention, which is defined by the claims which follow. While the preferred embodiment shows a three portion bristle, it could be that a bristle could have two portions, including the first portion which can readily enter between teeth and gums.

What is claimed is:

1. A toothbrush bristle, comprising:

a bristle member adapted for use as part of a set of toothbrush bristles in forming a toothbrush brushhead, wherein the bristle member has a stepped configuration, including a smallest diameter, flexible top portion at an upper end of the bristle member having a diameter of approximately 0.005 inches and a length of approximately 0.01 inches, a middle portion having a diameter slightly larger than the top portion, approximately 0.006 inches, and a base portion having the largest diameter, providing stiffness and support for the bristle member, the base portion having a diameter of approximately 0.007 inches, wherein the top, middle and base portions are all straight and have substantially uniform diameters along their respective lengths.

2. A bristle of claim 1, wherein the top portion has such a diameter and is otherwise configured to conveniently enter between teeth and gums of a user.

3. A bristle of claim 1, wherein the top bristle portion has a free end which is rounded to facilitate entry of the top bristle portion between the teeth and gums of the user.

4. A brushhead, comprising:

a plurality of tufts of bristle members, the tufts arranged and set into a base plate to form a brushhead, wherein the bristle member has a stepped configuration, including a smallest diameter flexible top portion at an upper end of the bristle member having a diameter of approximately 0.005 inches and a length of approximately 0.01 inches, a middle portion having a diameter of approximately 0.006 inches and a length of approximately 0.01 inches, and a base portion having the largest diameter, providing stiffness and support for the bristle member, wherein the base portion has a diameter of approximately 0.007 inches wherein the top portion otherwise configured to conveniently enter between teeth and gums of a user.

* * * * *